United States Patent [19]

Rohr et al.

[11] 4,032,285

[45] June 28, 1977

[54] METHOD AND APPARATUS FOR THE AUTOMATIC CONTROL OF THE AIR RATIO OF A COMBUSTION PROCESS

[75] Inventors: Franz Josef Rohr, Absteinach; Hubert Holick, Lampertheim, both of Germany

[73] Assignee: Brown, Boveri & Cie. A.G., Mannheim, Germany

[22] Filed: Dec. 19, 1975

[21] Appl. No.: 642,449

[30] Foreign Application Priority Data

Dec. 19, 1974 Germany ..... 2460066

[52] U.S. Cl. ..... 431/12; 123/119 E; 431/76; 431/90

[51] Int. Cl.[2] ..... F23N 5/10

[58] Field of Search ..... 131/12, 90, 76; 123/119 E, 32 E, 119 EC; 137/6, 90

[56] References Cited

UNITED STATES PATENTS

| | | | |
|---|---|---|---|
| 3,241,597 | 3/1966 | Juzi | 431/12 X |
| 3,388,862 | 6/1968 | Gabrielson | 431/12 X |
| 3,549,089 | 12/1970 | Hamlett | 431/12 X |
| 3,768,955 | 10/1973 | McLaughlin | 431/12 |
| 3,814,570 | 6/1974 | Guigues et al. | 431/76 |

*Primary Examiner*—Edward G. Favors
*Attorney, Agent, or Firm*—Herbert L. Lerner

[57] ABSTRACT

A method for automatically controlling the air ratio of a combustion process by adjustment of the fuel-air mixture as function of the air number, the air number of the exhaust gas being measured with a sensor which is particularly sensitive at an air number of a given magnitude, and the combustion process operating with an air ratio having an air number of a different magnitude out of the sensitivity range of the sensor which includes extracting a hot exhaust gas stream from a combustion process having an air ratio with an air number out of the given sensitivity range of a sensor changing the amount of air in the exhaust gas stream to provide an auxiliary gas stream having an air number in the sensitivity range of the sensor, measuring the air number of the auxiliary gas stream to detect the difference from the air number of the given magnitude, and controlling the air ratio of the combustion process to maintain the air number of the auxiliary gas stream at the given magnitude, and apparatus for carrying out the foregoing method.

28 Claims, 4 Drawing Figures

METHOD AND APPARATUS FOR THE AUTOMATIC CONTROL OF THE AIR RATIO OF A COMBUSTION PROCESS

FIELD OF THE INVENTION

The invention relates to a method and apparatus for the automatic control of the air ratio of a combustion process, particullarly the combustion in an internal-combustion engine, through adjustment of the fuel-air mixture intended for combustion, as a function of the air number λ. The air number λ of the exhaust gas is measured by a solid-electrolyte-oxygen measuring sensor which is particularly sensitive at an air number of the magnitude λ = 1.

DESCRIPTION OF THE PRIOR ART

Controlling the air ratio of internal-combustion engines to an air number of λ = approximately 1, is known or described in MTZ Motortechnische Zeitschrift 34 (1973) No. 1, pages 7 to 11. A zirconium dioxide measuring probe, used as the sensor for the air number, has the special property that the e.m.f. generated by it changes suddenly by a fairly large amount in the vicinity of the air number of λ = about 1. In other regions, no strong dependence of the e.m.f. on the air number is found. The probe therefore is particularly well suited for control of an air number of λ= about 1. In the known regulator, this property of the measuring probe is no disadvantage, as the air ratio is to be regulated to an air number of λ = about 1.

In many cases, however, control of the air ratio to air numbers different from the value of λ = about 1 is desired. Thus, an air number of λ = about 1.25, representing excess air, is required, for example, for the operation of an otto engine having small amounts of nitrous oxides in the exhaust gas, while for starting the engine, an air number λ<1, indicating an air deficiency, must usually be employed. In furnace installations, as well, the fuel is usually burned with excess air and control of the air ratio of λ> 1 is therefore also required.

SUMMARY OF THE INVENTION

It is therefore an object of the invention of the instant application to provide a method and apparatus for control of the air ratio of a combustion process which can be applied to any desired air ratio outside the particular sensitivity range of the measuring sensor. It is a further object that the method and apparatus should be relatively easy to implement in all applications and be able to withstand various operational conditions.

In order to maintain a desired air ratio utilizing air numbers outside the particular sensitivity range of the measuring sensor, an auxiliary gas stream is admixed with the hot stream exhaust gas provided for the measurement, or a catalyst may be employed to remove a gas component from the exhaust. A corrected stream of exhaust gas is thus generated, the air number of which is measured by the measuring sensor and is controlled to a value of λ = about 1. The admixed stream auxiliary gas or the removed gas component, respectively, is selected and apportioned so that the desired arbitrary air ratio of the actual combustion, which deviates from λ = about 1, is self-adjusting if the air number of the corrected gas stream is controlled to a value of λ = about 1.

The exhaust gas stream to be measured is therefore always kept at or regulated to an air of λ = about 1, while the actual combustion takes place with other air ratios. In order to adjust these ratios to the desired values, or to change the exhaust gas stream to be measured, an auxiliary gas or several auxiliary gases are fed in simultaneously or one or more exhaust gas components are removed. This provides the advantage that the solid electrolyte oxygen measuring sensor, which is particularly sensitive at λ = about 1, can also be used for regulating values of λ greater or less than 1. Other known control methods require separate equipment for air number of λ < 1 and λ > 1 and must measure all the gas components and determine the air number by computer. In comparison therewith, the method and apparatus described herein are considerably simplified and can be implemented with little expense.

In order to keep the required amount of auxiliary gas or the amounts of removed exhaust gas low, it is advantageous to use and measure only a part of the total exhaust gas stream, such as substream exhaust gas.

In regulating the air ratio to maintain a constant value, satisfactory results are achieved by keeping a constant ratio between the amount of the exhaust gas stream and the auxiliary gas stream or the amount of removed gas.

If, however, the air ratio is to be varied in a simple manner, it is advantageous to vary the flow of the auxiliary gas stream or the removed gas components and/or the exhaust gas stream intended for the measurement. In this manner, any desired air ratio can be set without intervening in the main control system.

In this connection, it is particularly advisable to maintain a constant exhaust gas stream for the measurement. Only the flow of the auxiliary gas stream or the amount of removed gas is changed. The adjustment of the desired air ratios is therefore considerably simplified .

In order to readily preselect the air ratio of the self-adjusting actual combustion, the amount of auxiliary gas fed in or the amount of the removed exhaust gas component is advantageously used as a measure for the desired arbitrary air ratio which deviates from λ = 1.

A simple adjustment of the air ratio to an excess of air (λ > 1), is obtained by admixing an auxiliary gas having a reducing action with the exhaust gas stream to be measured. To adjust for an air deficiency, an auxiliary gas with an oxidizing action is used.

The exhaust gas-auxiliary gas mixture may be combined at the catalyst and regulated to form the correction exhaust gas stream intended for measurement.

To simplify the procurement of the auxiliary gases, it is advantageous to use oxygen as the oxidizing auxiliary gas and hydrogen as the reducing auxiliary gas. Instead of the reducing auxiliary gas, a fuel such as gasoline or its decomposition products can also be used. The gasoline can be injected into the exhaust gas stream to be measured. It is also advantageous to generate the hydrogen or the oxygen electrolytically and to feed it directly into the exhaust gas stream to be measured, apportioning it by means of the current used for the electrolysis. Storing and metering of the auxiliary gas is thereby simplified.

In one preferred embodiment of the method, the oxygen is taken from the ambient air by means of a solid-electrolytic cell and directly fed into the exhaust gas stream to be measured. The quantity is controlled by means of the current fed to the solid-electrolytic cell. This avoids the need for additional gas storage or gas generators. In addition, the output side of the electrode of the solid-electrolytic cell can also be used at the same time as the catalyst. This results in further simplification.

If use is made of the adjustment of the air ratio by removal of gas components from the exhaust gas stream to be measured, the simplest method is to control the combustion of excess air by removing oxygen from the exhaust gas stream. For this purpose, a solid-electrolytic cell is advantageously used with the removed quantity of oxygen being adjusted by means of the current conducted through the solid-electrolytic cell. In order to keep the total cost low, joint use is made of one solid-electrolytic cell for both the removal and the supply of oxygen.

It is also advantageous to use the electrode on the exhaust gas side of the solid-electrolytic oxygen measuring sensor as a catalyst at the same time. However, particularly in the case of lead-containing exhaust gas, it is better to conduct the exhaust gas stream to the solid-electrolytic oxygen measuring sensor through a separate catalyst. Separation of the catalysis and measurement by use of separate elements reduces possible damage to the measuring sensor by the lead contained in the exhaust gas and increases its life.

The apparatus for implementing the described method is particularly useful with an internal-combustion engine which includes a regulator to adjust the fuel-air mixture. The pickup for measuring the air number $\lambda$ is provided in the exhaust gas line and is formed of a solid-electrolytic oxygen measuring sensor. Means are provided to supply a given quantity of an auxiliary gas stream or to remove a gas component from the exhaust gas stream to be measured. The feed in and/or take-off point is positioned upstream ahead of the measuring sensor and catalyst, if one is used.

In a preferred embodiment, the feed in and/or take-off point, the catalyst and the measuring sensor are disposed in an exhaust gas branch line. The device is thereby made independent of the main exhaust line and the correction and measurement of the exhaust substream can also be performed at a point remote from the exhaust gas line.

If, on the other hand, a very compact design is to be achieved, it is advisable to design the exhaust branch line as a tube having open ends positioned within the exhaust gas line. The tube is approximately aligned with the exhaust gas line and has a small cross sectional area compared to that of the exhaust gas line.

To keep the exhaust gas stream in the exhaust gas branch line constant, it is advantageous to connect the suction side of an exhaust gas blower to the exhaust gas branch line at a flow location following the measuring sensor. This is preferably connected through a choke, with the output of the exhaust gas blower being adjustable to any desired constant value. The choke represents a high resistance for the exhaust gas substream, so that pressure and/or quantity variations of the exhaust gas stream no longer have any effect on the exhaust gas substream. A constant exhaust gas substream can then adjust itself in a simple manner.

The means for supplying of a given quantity of the auxiliary gas stream includes at least auxiliary gas source, a connecting line going from the source to the exhaust gas line or the exhaust gas branch line, and an interposed control element. The auxiliary gas source can be formed substantially of an electrolytic cell or a reservoir of solid matter.

If the correction of the exhaust gas stream to be measured is accomplished by feeding-in or taking-out oxygen, it is particularly useful that the means supplying the given quantity of gas or providing removal of oxygen include a solid-electrolytic cell. One side wall of the cell is disposed adjacent the exhaust gas stream to be measured and the other side faces the outside space. The electric current flowing through the solid-electrolytic cell is adjustable to supply the given quantity of oxygen.

In order to simplify this design, the solid-electrolytic cell simultaneously forms part of the exhaust gas line or the exhaust gas branch line.

If the apparatus is to be used for exhaust gases with a temperature below the minimum temperature required for the catalysis or measurements of, for example, 300° C, the exhaust gas line or the branch line may be provided with an electrical heater in the vicinity of the measuring sensor and/or the catalyst. In this manner, the minimum temperature required for the reaction at the catalyst or for the measurement with the measuring sensor can readily be maintained. Other features which are considered as characteristic for the invention are set forth in the appended claims.

Although the invention is illustrated and described herein as embodied in method and apparatus for the automatic control of the air ratio of a combustion process, it is nevertheless not intented to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings.

DESCRIPTION OF THE PREFERRED EMBODIMENT

Figure 1:
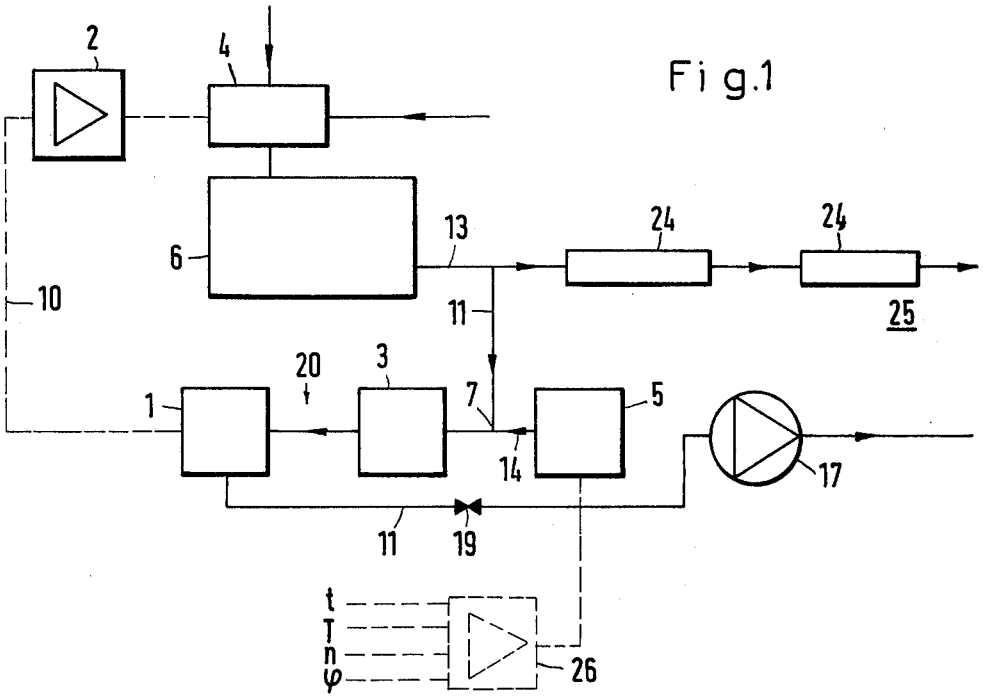
FIG. 1 is a schematic block diagram showing the overall design of the control system for an Otto engine.

FIG. 1 shows the control apparatus of the invention as a schematic block diagram for an Otto engine. The exhaust gas branch line 11 is connected to the exhaust gas line 13 of the Otto engine 6 in the path of flow ahead of the exhaust gas installation 24, which may consist of mufflers. Attached to the exhaust gas branch line, at the feed point for the auxiliary gas 7, is a connecting line 14 coming from an auxiliary gas source 5. The auxiliary gas source 5 is connected via a control line to a control unit 26 as shown in dashed lines. After the feed point 7 for the auxiliary gas, the exhaust gas branch line leads to a catalyst 3 and then to the measuring sensor 1. From the measuring sensor, the exhaust gas branch line 11 runs through an adjustable choke 19 to the section side of an exhaust gas blower 17, the output side of which is open to the outside 25, as is the exhaust gas installation 24. The measuring sensor 1 is connected via electrical lines 10 shown dashed, to an amplifier 2, which in turn has a connection to a control element 4 which apportions the air and/ or fuel supply to the Otto engine in accordance with amplifier signal In the embodiment FIG. 1, the measuring sensor and the catalyst as well as the feed point for the auxiliary gas are provided in an exhaust gas branch line. It would also be possible to provide these elements in the exhaust gas line 13. This would make no difference as far as the control function is concerned.

Figure 2:
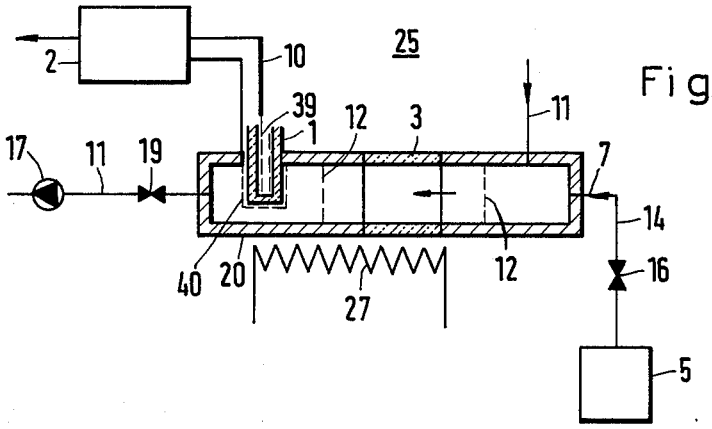
FIG. 2 schematically shows an axial longitudinal cross section through a section of an exhaust gas branch line in the vicinity of the measuring sensor and the catalyst.

FIG. 2 shows an axial longitudinal cross section of a section 20 of the exhaust gas branch line 11 which contains the feed point 7 for the auxiliary gas 5, the catalyst 3 and the measuring sensor 1. This section is of tubular design and includes a gas mixer in the form of a first screen 12 ahead of the tubular catalyst 3. Another gas mixer 12 is provided between the catalyst 3 and the measuring sensor 1. The measuring sensor 1 itself is formed of a catalytically active solid-electrolyte oxygen measuring probe in the form of a tube of zirconium dioxide. The inside and outside of the tube are each provided with a porous platinum electrode 39, 40. The closed end extends into the exhaust gas branch line, with the exhaust gas stream to be measured flowing around it. The inside of the tube is in communication with the outside space 25. The signals derive from the electrodes are connected by electric lines 10 to amplifier 2. An electric heater 27 in the form of a heating coil is provided on the outside of the exhaust gas branch line in the vicinity of the catalyst and the measuring sensor. The feed point 7 for the auxiliary gas is provided at one end of the section 20 ahead of the catalyst 3 and ahead of the screen 12. The auxiliary gas is contained in an auxiliary gas source 5, which is connected via a connecting line 14 and a control element 16 with the feed point 7. The exhaust gas branch line 11 is continued at the other end of the section 20 behind the sensor 1 via the choke 19 to the suction side of the exhaust gas blower 17, the discharge of which goes into the outside space 25. The control member 16 is set by the control unit 26 indicated in FIG. 1.

In the embodiment of FIG. 2, the catalyst 3 is of tubular shape and is inserted into the section 20 of the exhaust gas branch line so that there are no seams. However, any other suitably shaped catalyst could be used. In order to improve the effect of the screen 12, disposed ahead of the catalyst, it is advantageous to provide a mixing section between the screen and the catalyst. For example, the distance between the catalyst and the screen 12 should correspond to about two to three times the inside diameter of the exhaust gas branch line. If the mixing section is suitably long, a mixing screen may not be necessary.

Figure 3:
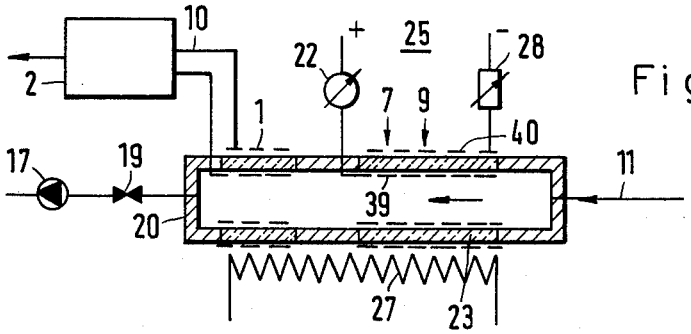
FIG. 3 schematically shows an axial longitudinal cross section through a section of the exhaust gas branch line with a solid electrolytic cell supplying or removing oxygen to or from the exhaust gas.

FIG. 3 shows an axial longitudinal cross section of section 20 of the exhaust gas branch line which is provided to supply or remove oxygen. This embodiment utilizes the additional property of a solid-electrolyte cell 23 which permits oxygen transport through its wall as a result of the passage of current through the wall of the cell by means of the inner and outer porous electrodes 39, 40, which may be of platinum. The direction of the oxygen transport depends on the direction of the current. Such a solid-electrolyte cell of zirconium dioxide, for example, is inserted into the section 20. In the embodiment of FIG. 3, it is of tubular shape and forms part of the section 20. The inner porous electrode 39 at the same time also forms the catalyst which is connected via an ammeter 22 to one terminal of a d-c source. Another porous electrode 40 is similarly attached to the outer, opposite side of the solid-electrolyte cell and connected with the second terminal of the d-c source via a variable resistor 28. This solid-electrolyte cell is used both to supply oxygen from the outer space to the exhaust gas stream or for removing oxygen from the exhaust gas stream. In addition, the inner electrode is also used as a catalyst.

In the flow path following the solid-electrolyte cell 23 is the measuring sensor 1 which in the present case also forms part of the exhaust gas branch line 11. Its inner and outer electrodes are connected via the electrical lines 10 to the amplifier 2, which acts on the control element 4. The exhaust gas branch line is continued following the sensor via an adjustable choke 19 connected to the suction side of the exhaust gas blower 17 which discharges into the outer space 25. The measuring sensor 1 and the solid-electrolyte cell 23 are equipped with an electric heater 27 which may be in the form of a heater coil.

Figure 4:
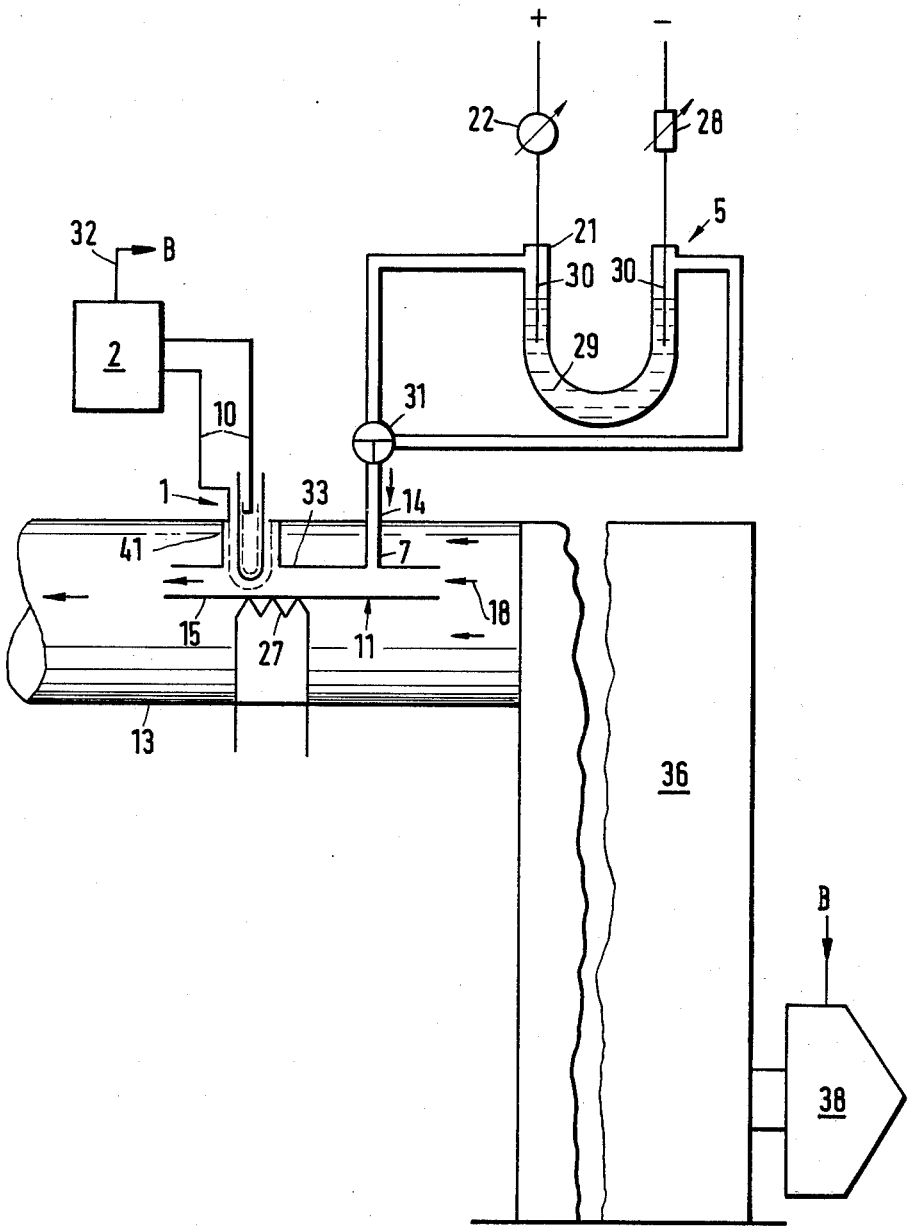
FIG. 4 schematically shows a side sectional view of an oil-fired boiler with an exhaust gas line including a branch line.

FIG. 4 shows a side view of a boiler 36 having a furnace equipped with an oil burner 38. A short tube 15 which serves as the exhaust gas branch line 11 is provided inside the exhaust gas line 13. The tube is open at the ends and has a small diameter relative to the exhaust gas line. The tube is spaced from and aligned with the exhaust gas line and is disposed in proximity to the exhaust gas discharge from the boiler. A stub 14 supports the tube 15 in the exhaust gas line 13. The interior of the stub 41 accommodates part of the measuring sensor 1 and thus forms a shield for the measuring sensor against the exhaust gas stream 18 as it passes through the exhaust gas tube 13. Ahead of the measuring sensor within tube 15 is the feed point 7 for the auxiliary gas provided to the tube 15 through an opening connected to the auxiliary gas source 5 by a connecting line 14.

The measuring sensor 1 has a form and disposition similar to those of the measuring probe of FIG. 2. A separate catalyst is not provided, however, since the electrode of the solid electrolyte oxygen measuring sensor is simultaneously used as the catalyst. An amplifier 2 is connected to the measuring sensor in the usual manner and is connected via electric lines 34 to the burner 38 for controlling the mixture. An electric heater 27 may also be provided in the vicinity of the measuring sensor 1, if necessary.

In the embodiment of FIG. 4, the auxiliary gas is generated in an electrolytyc cell 21 which is formed of a U-shaped tube which is filled with an aqueous electrolyte 29. In it are immersed electrodes 30, which are connected to a d-c source via an ammeter 22 and a variable resistor 28, respectively. The gas chambers of the two legs of the eletrolytic cell 21 are each connected via a pipe line with a three-way valve 31, the third connection of which is provided for connecting to line 14. Through a suitable setting of the three-way valve 31, the feed point 7 can be selectively connected with the side of the electrolytic cell generating either oxygen or hydrogen.

The operation of the apparatus and the processing cycle will be explained in further detail, first with reference to FIG. 1.

If the air ratio for operating the Otto engine 6 is to be controlled to an air number which is outside the sensitivity range of the measuring sensor, then a given quantity of auxiliary gas from the auxiliary gas source 5 is admixed at the feed point 7 to the exhaust gas stream or substream to be measured. The exhusted gas-auxiliary gas mixture is not conducted to the catalyst 3, where its components, as the case may be, react with each other, so that a new corrected exhaust gas stream is produced. The latter is drawn through the measuring sensor 1 and the choke 19 by the exhaust gas blower 17 and blown into the outside space 25. The exhaust gas blower produces a uniform flow of the exhaust gas to be measured. This is aided by the adjustable choke 19, which causes a large pressure drop, so that pressure and/or flow rate changes in the exhaust gas line 13 have only little or no influence on the amount of exhaust gas branched off by the exhaust gas blower. The signal measured by the measuring sensor is passed on via the electric lines 10 to an amplifier 2, which acts on the control member 4 that adjusts the proportion of fuel and air of the fuel-air mixture fed in. The air and the fuel can be mixed outside the engine, such as in a carburetor, or within the cylinders of the engine, such as by air suction and fuel injection.

For control of an air number $\lambda > 1$, hydrogen, for example, is admixed with the exhaust gas stream to be measured. The hydrogen reacts in the catalyst 3 with the exhaust gas and a corrected exhaust gas stream is produced which exhibits an air deficiency and therefore, an air number of $\lambda < 1$. The measuring sensor now quickly registers the deviation from its sensitivity range and, via the amplifier 2 and the control element 4, causes an increased amount of air to be admixed with the fuel-air mixture. This amount is increased until the air content in the exhaust gas is so high that the reaction of the exhaust gas to be measured with the added hydrogen in the catalyst 3, produces a corrected exhaust gas stream with the air number of $\lambda$ = about 1, which is held by the regulator. The combustion takes place with excess air because of the increased air supply. The amount of hydrogen fed-in per unit time determines the magnitude of the air excess, and air numbers can be correlated directly with the quantities of hydrogen.

If the engine is to be operated, however, with an air deficiency i.e. with an air number $\lambda < 1$, then oxygen is fed-in as the auxiliary gas. An air number $\lambda > 1$ (excess air) is now registered at the measuring sensor 1 and the air supply is caused to be throttled at the control member 4 or the fuel supply is increased, which would be equivalent, or both. The combustion in the engine takes place with an air deficiency and its exhaust gas contains unburned components. The control is effective until an air number of $\lambda$ = about 1 is again measured at the measuring sensor or until the fed-in amount of oxygen has compensated the unspent components of the exhaust gas stream intended for the measurement, and an air number of $\lambda$ = about 1 has again been reached.

Through the supply of an appropriate auxiliary gas alone, the air ratio of the combustion can therefore be adjuasted to any desired value by regulating the air number of the exhaust gas stream to be measured to a value of $\lambda$ = about 1.

In the case of the Otto engine, the metering of the auxiliary gas is controlled in an advantageous manner via the engine temperature and/or its speed and/or other factors, such as the control unit 26.

In the apparatus according to FIG. 2, the auxiliary gas is admixed with section 20 of the exhaust gas branch line 11 at feed point 7. To improve the mixing, a gas mixer in the form of a screen 12 follows in the flow direction, so that a uniform exhaust gas-auxiliary gas mixture enters the catalyst 3. Here, the auxiliary gas reacts with the exhaust gas components, is mixed again in the following screen 12 and is conducted to the measuring sensor 1. As a certain minimum temperature is required for the reaction at the catalyst and for the measurement, an electric heater 27 is provided which is put in operation if, for example, the exhaust gas is colder than 300° C. The adjustment to different air ratios is accomplished in the same manner as described before.

Instead of supplying hydrogen, oxygen, if present, can also be removed from the exhaust gas stream in order to adjust an air deficiency of the corrected exhaust gas stream and to cause the control system to supply more air for the combustion. Apparatus suited for this purpose is shown in FIG. 3, with which it is also possible to supply oxygen to the exhaust gas steam to be measured.

If oxygen is to be removed from the exhaust gas stream to be measured, a d-c current is sent to the solid-electrolyte cell via the electrodes 39, 40 in the appropriate direction. As a consequence, oxygen transport through the wall from the interior of the solid-electrolyte cell 23 to the outside space 25 and the air number for the exhause gas stream to be measured becomes smaller. The measuring sensor 1 detects this condition and compensates it in the manner described above by increasing the air supply for the combustion.

If the combustion is to take place with an air deficiency, oxygen is supplied to the exhaust gas stream to be measured by reversing the direction of the electric current which flows through the wall of the solid-electrolyte. Now oxygen is taken from the outside space 25 and fed to the exhaust gas stream to be measured. An excess of air results, which is registered by the measuring sensor and is compensated by throttling the air supply for the combustion, until the air number of $\lambda$ = about 1 is again measured at the sensor. The amount of oxygen removed or supplied per unit of time can be used as a measure for the air numbers.

In the present example, a separate catalyst is not necessary; the solid-electrolyte cell 23 being used simultaneously as such. In addition, a heater 27 is provided which is put in operation if needed.

In the embodiment according to FIG. 4, a short tube 15, open at the ends, is directly inserted into the exhaust gas line as the exhaust gas branch line. Part of the exhaust gas 18, which leaves the boiler, flows through this open tube. Shortly after it enters the tube, the auxiliary gas is admixed at the feed point 7. With the interposition of a mixing section 33, it arrives at the measuring sensor 1. Here, again, no separate catalyst is interposed since the electrode of the measuring sensor on the exhaust gas side also takes on the function of the catalyst. The result of the measurement is fed via lines to the amplifier 2, which is connected via an electric line 34 with the oil burner 38 for the fuel-air control. As furnaces are usually operated with excess air, a reducing auxiliary gas, such as hydrogen, is added to the exhaust gas stream to be measured, so that a corrected exhaust gas stream with air deficiency is produced. By supplying more air for the combustion process, the oxygen content of the exhaust gas 18 is increased until the corrected exhaust gas mixture present at the measuring sensor 1 has an air number of $\lambda$ = about 1, which is maintained by the control system while the combustion takes place with excess air.

In the FIG. 4 embodiment, the hydrogen, and when required, also the oxygen, are generated in an electrolytic cell 21. For this purpose, a suitable aqueous electrolyte is decomposed and the hydrogen generated is admixed with the auxiliary gas. The amount the auxiliary gas can be adjusted via the current used for the electrolysis. To check this adjustment, a variable resistor 28 and an ammeter 22 are provided in the current leads. In principle, any kind of auxiliary gas generator or accumulator can be used as the auxiliary gas source, such as, for example, a solid-matter reservoir or compressed-gas storage. The kind of auxiliary gas also does not matter. It must merely provide a reducing action in the one case and oxidizing action in the other case. Thus, a fuel-air mixture, for instance, can also be used as the reducing auxiliary gas.

It is apparent that the control system according to FIG. 4 can also be used for Otto engines, and the embodiment shown in FIGS.2 and 3 can also be applied to boilers.

There are claimed:

1. A method for automatically controlling the air ratio of a combustion process by adjustment of the fuel-air mixture as a function of the air number $\lambda$, the air number $\lambda$ of the exhaust gas being measured with a sensor which is particularly sensitive at an air number of a given magnitude, and the combustion process operating with an air ratio having an air number of a different magnitude of the sensitivity range of said sensor which comprises extracting a hot exhaust gas stream from the combustion process having an air ratio with an air number out of the given sensitivity range of a sensor changing the amount of air in said exhaust gas stream to provide an auxiliary gas stream having an air number in said sensitivity range of said sensor, measuring the air number of said auxiliary gas stream detect the difference from said air number of said given magnitude, and controlling the air ratio of said combustion process to maintain said air number of said auxiliary gas stream at said given magnitude.

2. The method according to claim 1, wherein a portion of the hot exhaust gas stream extracted, the air in said portion being changed to provide said auxiliary gas stream.

3. The method of claim 2, wherein said given magnitude of said air number $\lambda$ is approximately equal to 1.

4. The method of claim 3, wherein said amount of air is changed by selectively adding an amount of air to said portion of said exhaust gas stream when said exhaust gas stream has an air number less than 1 and removing an amount of air from said portion of said exhaust gas stream when said exhaust gas stream has an air number greater than 1.

5. The method of claim 4, wherein said combustion process is in an internal combustion engine.

6. The method according to claim 4 which includes maintaining a constant ratio between the amounts of the exhaust gas stream and the auxiliary gas stream.

7. The method according to claim 4 which includes varying the flow of the auxiliary gas stream to vary the air ratio of the combustion process.

8. The method according to claim 4 which includes measuring the amount of change of air provided in said auxiliary gas stream as a measure of the air ratio of the combustion process having an air number different from said given magnitude.

9. The method according to claim 3 which includes selectively changing said amount of air by supplying an auxiliary gas having a reducing action to adjust the air ratio to have excess air and an air number $\lambda$ greater than one, and by supplying gas having an oxidizing action to adjust to an air deficiency with an air number $\lambda$ less than one.

10. The method according to claim 9 which includes feeding in oxygen as the oxidizing auxiliary gas.

11. The method according to claim 9 which includes feeding in hydrogen as the reducing auxiliary gas.

12. The method according to claim 9 which includes feeding in a fuel as the reducing auxiliary gas.

13. The method according to claim 9 including electrolytically generating said auxiliary gas.

14. The method according to claim 4, wherein oxygen is removed from said portion of said exhaust gas stream.

15. Apparatus for automatically controlling the air ratio of the combustion process by adjustment of the fuel-air mixture as a function of the air number $\lambda$ comprising:

combustion means operating at a selected air ratio and providing an exhauxt gas stream having selected air number $\lambda$ ;

means for adjusting the fuel-air mixture of said combustion means to control said air ratio;

means for extracting a portion of the exhaust gas stream;

sensor means for sensing the air number of said portion of said exhaust gas stream, said sensor means being sensitive at an air number of a given magnitude different from that of said exhaust gas;

means for changing the amount of air in said portion of said exhaust gas stream to provide an auxiliary gas stream having an air number in the sensitivity range of said sensor means, said sensor means measuring the air number of said auxiliary gas stream to detect the difference from said air number of said given magnitude; and means connecting said sensor means to said means for adjusting the fuel-air mixture of said combustion means to maintain said air number of said auxiliary gas stream at said given magnitude.

16. The apparatus of claim 15, wherein said given magnitude of said air number $\lambda$ is approximately 1.

17. The apparatus of claim 16, wherein said means for changing said amount of air selectively adds an amount of air to said portion when said exhaust gas stream has an air number less than 1 and removes an amount of air from said portion when said exhaust gas stream has an air number greater than 1.

18. The apparatus of claim 17, wherein said combustion means is an internal combustion engine.

19. The apparatus of claim 17, wherein said sensor means are a solid-electrolytic oxygen measuring sensor.

20. The apparatus of claim 19, wherein said means for extracting a portion of said exhaust gas stream includes a branch exhaust line, and said means for changing said amount of air includes an auxiliary gas source connected to said branch exhaust line.

21. The apparatus of claim 20, wherein said sensor is disposed in said branch line downstream from the connection to said auxiliary gas source.

22. The apparatus of claim 21 including a catalyst in said branch line ahead of said sensor.

23. The apparatus of claim 19, wherein said means for changing said amount of air to provide an auxiliary gas stream includes a solid electrolytic cell adapted to add and remove oxygen, and means applying adjustable current to said cell to control the addition and removal of said oxygen.

24. The apparatus of claim 23, wherein said cell is also a catalyst.

25. The apparatus of claim 20, wherein said branch line is an open tube within said exhaust gas stream.

26. The apparatus of claim 20 including an adjustable choke and an exhaust gas blower connected to said branch line.

27. The apparatus of claim 19 including electrical heater means adjacent said sensor.

28. The apparatus of claim 19, wherein said sensor is formed of zirconiun dioxide.

* * * * *